United States Patent [19]

Goekler

[11] Patent Number: 5,022,595

[45] Date of Patent: Jun. 11, 1991

[54] TENSIONING DEVICE

[76] Inventor: R. G. Goekler, 17813 E. 93rd St. North, Owasso, Okla. 74055

[21] Appl. No.: 559,372

[22] Filed: Jul. 26, 1990

Related U.S. Application Data

[63] Continuation of Ser. No. 426,537, Oct. 24, 1989, abandoned, which is a continuation of Ser. No. 199,124, May 26, 1988, abandoned.

[51] Int. Cl.[5] ..... B65H 81/08

[52] U.S. Cl. ..... 242/7.23; 242/7.08; 242/7.22; 242/75.2

[58] Field of Search ..... 242/7.08, 7.21, 7.22, 242/7.23, 75.2, 75.4, 147 R, 151; 226/108, 195; 57/3, 10, 11

[56] References Cited

U.S. PATENT DOCUMENTS

| | | | |
|---|---|---|---|
| 1,716,375 | 6/1929 | Fowler | 226/108 |
| 2,370,254 | 2/1945 | Mickelson | 242/75.2 X |
| 2,657,866 | 11/1953 | Lungstrom | 242/11 |
| 2,779,552 | 1/1957 | Jarvis | 242/153 |
| 3,099,190 | 7/1963 | Allen, Jr. et al. | 93/80 |
| 3,282,486 | 11/1966 | De Moss | 226/181 |
| 3,390,824 | 7/1968 | Alexeff | 226/195 |
| 3,470,057 | 9/1969 | Stuart, Jr. et al. | 156/392 |
| 3,547,731 | 12/1970 | Stuart, Jr. et al. | 156/392 |
| 3,737,089 | 6/1973 | Slavic | 226/156 |
| 3,756,004 | 9/1973 | Gore | 57/11 |
| 4,046,064 | 9/1977 | Wahle | 242/75.2 X |
| 4,069,088 | 1/1978 | Cottam | 156/392 |
| 4,113,545 | 9/1978 | Stuart, Jr. et al. | 156/392 |
| 4,124,156 | 11/1978 | Waffner | 226/25 |
| 4,125,422 | 11/1978 | Stuart, Jr. et al. | 156/394 |
| 4,130,453 | 12/1978 | Hollister | 156/187 |
| 4,199,117 | 4/1980 | Muller et al. | 242/75.2 |
| 4,279,683 | 7/1981 | Landsness | 156/495 X |
| 4,322,262 | 3/1982 | Cottam | 156/392 |
| 4,358,064 | 9/1982 | Garneau | 242/7.23 |
| 4,610,403 | 9/1986 | Goekler | 242/7.23 |

FOREIGN PATENT DOCUMENTS

| | | | |
|---|---|---|---|
| 2149754 | 4/1973 | Fed. Rep. of Germany | 226/108 |

*Primary Examiner*—Joseph J. Hail, III

*Attorney, Agent, or Firm*—Robert E. Massa

[57] ABSTRACT

A device and method for tensioning a strip of material, such as tape, traveling from a material source, such as a tape spool, to a material user, such as a pipe or similar conduit. The device includes a first roller, a second roller, and an interconnection assembly. The first roller is positioned for non-slidingly contacting a portion of the strip of material so that the portion of the strip of material contacting the first roller travels at the same velocity as the tangential velocity of the outside surface of the first roller. The second roller is positioned for non-slidingly contacting a portion of the strip of material in the path of travel of the strip of material between the first roller and the material user so that the portion of the strip of material contacting the second roller travels at the same velocity as the tangential velocity of the outside surface of the second roller. The interconnection assembly simultaneously rotates the first and second rollers and rotates the outside surface of the first roller at a slower tangential velocity than the outside surface of the second roller so that the strip of material is tensioned between the first and second rollers. The first and second rollers may be positioned for contacting one side of the strip of material or may be positioned such that the strip of material serpentines through the rollers with one of the rollers contacting each side of the strip of material.

9 Claims, 5 Drawing Sheets

TENSIONING DEVICE

This is a continuation of co-pending application Ser. No. 426,537, filed on Oct. 24, 1989, now abandoned, which is a continuation of co-pending application Ser. No. 199,124, filed on May 26, 1988, now abandoned.

BACKGROUND OF THE INVENTION

The present invention generally relates to the wrapping of objects, such as pipe, with a strip of material, such as tape and, more particularly, it is concerned with a device for tensioning the material as it is wrapped about the object.

SUMMARY OF THE INVENTION

It is an advantage of the present invention to provide a tensioning device for tensioning a strip of material traveling from a material source to a material user which does not generate large amounts of heat.

It is an advantage of the present invention to provide such a tensioning device which is not oil cooled and does not require heat transfer considerations, modifications, or additions.

It is an advantage of the present invention to provide such a tensioning device which may contact only one side of the strip of material and therefore does not require movement of the tensioning device or threading of the strip of material through the tensioning device in order to install the strip of material in position for tensioning.

It is an advantage of the present invention to provide such a tensioning device which does not require spacial considerations to allow for movement or positioning of the tensioning device in order to install a strip of material in position for tensioning.

Accordingly, the present invention provides a tensioning device for tensioning a strip of material traveling from a material source to a material user which includes a first roller, a second roller, and interconnection means. The first roller has a rotatable outside surface positionable for non-slidingly contacting a portion of the strip of material so that the portion of the strip of material contacting the outside surface of the first roller travels at the same velocity as the tangential velocity of the outside surface of the first roller. The second roller has a rotatable outside surface positionable for non-slidingly contacting a portion of the strip of material between the first roller and a material user so that the portion of the strip of material contacting the outside surface of the second roller travels at the same velocity as the tangential velocity of the outside surface of the second roller. The inter-connection means simultaneously rotates the first and second rollers and rotates the outside surface of the first roller at a slower tangential velocity than the outside surface of the second roller. The first and second rollers are positionable for non-slidingly contacting one side of the strip of material.

BRIEF DESCRIPTION OF THE DRAWINGS

The present invention will be better understood by reference to the examples of the following drawings.

DETAILED DESCRIPTION OF THE PREFERRED EMBODIMENTS

Figure 1:
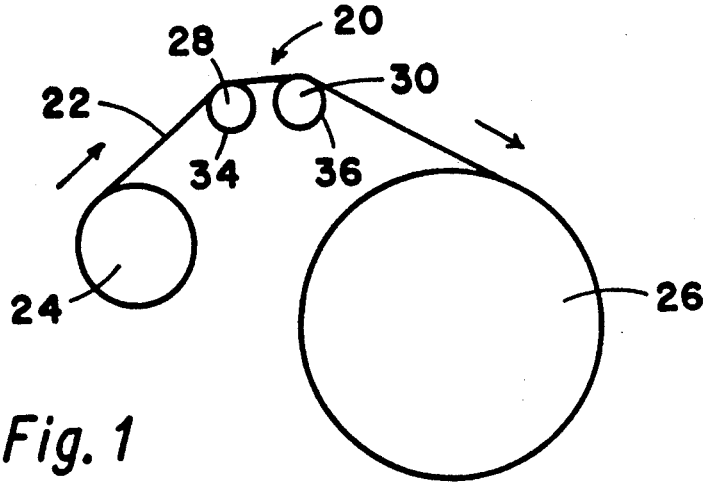
FIG. 1 is a schematic side view of a wrapping apparatus employing an embodiment of the tensioning device of the present invention.

Before explaining the present invention in detail, it is to be understood that the invention is not limited to the details of construction and arrangement of parts illustrated in the accompanying drawings, since the invention is capable of other embodiments and of being practiced or carried out in various ways commensurate with the claims herein. Also, it is to be understood that the phraseology or terminology employed herein is for the purpose of description and not of limitation.

FIGS. 1-9 present embodiments of the tensioning device, generally designated 20, of the present invention. The tensioning device is used for tensioning a strip of material 22 traveling from a material source 24 to a material user 26. Referring to the example of FIG. 8, the tensioning device may be described as being generally comprised of first roller 28, a second roller 30, and an interconnection means 32.

The first roller 28 has a rotatable outside surface 34 positionable for contacting a portion of the strip of material 22 so that the portion of the strip of material 22 contacting the outside surface 34 travels at the same velocity as the tangential velocity of the outside surface 34 of the first roller 28. By tangential velocity is meant the tangentially linear velocity of a point on the outside surface 34 of the first roller 28. The value of the tangential velocity can be ascertained by multiplying the angular velocity (velocity of rotation) of the first roller 28 times the radial distance from the axis of the roller to a point on the outside surface 34 of the first roller 28.

Figure 2:
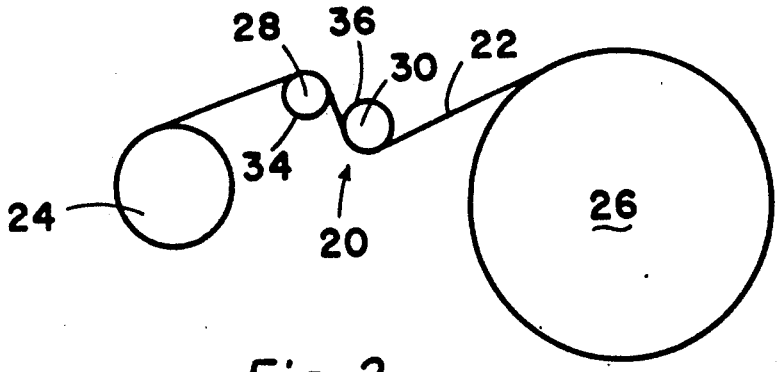
FIG. 2 is a schematic side view of a wrapping apparatus employing another embodiment of the tensioning device of the present invention.

The second roller 30 has a rotatable outside surface 36 positionable for contacting a portion of the strip of material 22 between the first roller 28 and the material user 26, as best illustrated in FIGS. 1 and 2, so that the portion of the strip of material 22 contacting the outside surface 36 of the second roller 30 travels at the same velocity as the tangential velocity (as defined above) of the outside surface 36 of the second roller 30.

Figure 8:
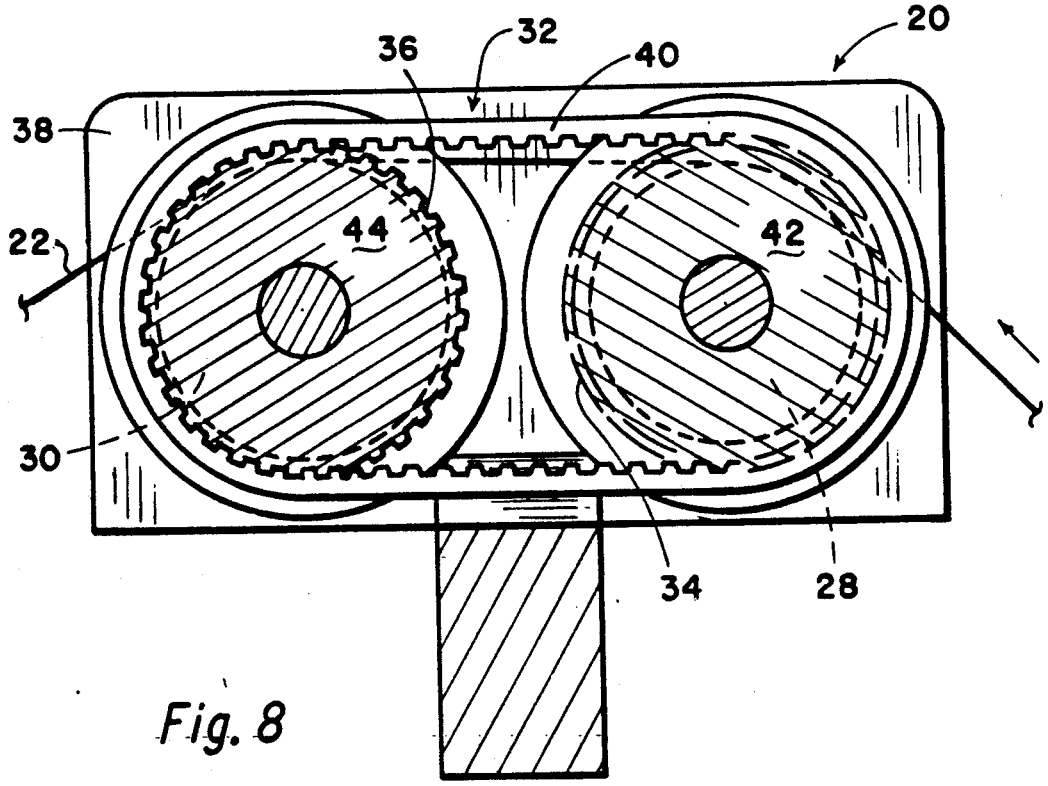
FIG. 8 is a sectional view taken along line 8-8 of FIG. 7.

Referring to the example of FIG. 8, the interconnection means 32 is normally connected between the first roller 28 and second roller 30. The interconnection means 32 should simultaneously rotate the first roller 28 and second roller 30 and should rotate the outside surface 34 of the first roller 28 at a slower tangential velocity than the outside surface 36 of the second roller 30. This results in the desired tensioning of the strip of material 22 since the portion of the strip of material 22 in contact with the outside surface 34 of the first roller 28 is traveling at a slower velocity than the portion of the strip of material 22 in contact with the outside surface 36 of the second roller 30. Normally, the outside surface 36 of the second roller 30 should be traveling at the same velocity as the strip of material 22 is being used by the material user 26 and the tensioning of the strip of material 22 between the first and second rollers 28, 30 will also be present between the material user 26 and the first and second rollers 28, 30.

The first roller 28 may be replaced by multiple rollers and the second roller 30 may be replaced by multiple rollers and the multiple first rollers 28 may be interconnected to the multiple second rollers 30 with one or more interconnection means 32 which simultaneously rotate the rollers 28, 30 as discussed above. Preferably, there is one first roller 28, one second roller 30, and one interconnection means 32 to simplify synchronizing the tangential and angular velocities of the rollers and to simplify the structure of the tensioning device 20, as exemplified in FIG. 8.

The rollers 28, 30 may take various cross-sectional shapes, e.g., polygonal, etc. although the circular shape illustrated is preferred. The axial length of the rollers 28, 30 as well as the diameter may be tailored for a specific application, e.g., to accommodate varying widths of the strip of material 22, the axial length of the rollers 28, 30 may be adjusted; to accommodate high-tension wrapping, such as wrapping protective tape on pipe, the diameter and structural strength of the rollers 28, 30 should be increased; if the strip of material 22 has a relatively low coefficient of friction, the diameter of the rollers 28, 30 may be increased to provide greater surface contact between the outside surface 34, 36 of the rollers 28, 30 and the strip of material 22, etc.

In order for the tensioning device 20 to properly function, the strip of material 22 can not slide freely across the outside surfaces 34, 36 of the first and second rollers 28, 30, i.e., the portion of the strip of material 22 in contact with the outside surface 34 of the first roller 28 must travel at approximately the same velocity as the tangential velocity of the first roller outside surface 34 and the portion of the strip of material 22 in contact with the second roller outside surface 36 must travel at approximately the same velocity as the tangential velocity of the second roller outside surface 36. Preferably, there should be little or no slippage between the portion of the strip of material 22 in contact with the first roller outside surface 34 and little or no slippage between the portion of the strip of material 22 in contact with the second roller outside surface 36 once the material user 26, tensioning device 20, and material source 24 have reached operating speed. In the preferred embodiment, the strip of material 22 makes effectively non-sliding contact with the first roller outside surface 34 and with the second roller outside surface 36.

There are several factors which contribute to reducing the slippage between the strip of material 22 and the outside surfaces 34, 36 of the first and second rollers 28, 30, such as, the coefficient of friction of the surface of the strip of material 22 in contact with the outside surfaces 34, 36 of the first and second rollers 28, 30; the coefficient of friction of the outside surfaces 34, 36 of the rollers 28, 30; the tendency of the strip of material 22 and the outside surfaces 34, 36 of the rollers 28, 30 to adhere to one another; the amount or area of contact between the strip of material 22 and the outside surfaces 34, 36 of the rollers 28, 30, etc.

If the strip of material 22 and/or the outside surface 34, 36 of the rollers 28, 30 is highly adhesive, the desired tensioning may be achieved by tangentially contacting the strip of material 22 to each of the outside surfaces 34, 36 of the first and second rollers 28, 30. Preferably, the first and second rollers 28, 30 are positionable so that the outside surfaces 34, 36 of the rollers 28, 30 effectively non-slidingly contact the strip of material 22, i.e., the amount of contact between the outside surface 34, 36 of each roller 28, 30 may be adjusted to achieve sufficient contact and friction to limit slippage and provide the desired tensioning. In the preferred embodiment, each roller 28, 30 is positionable for making greater than tangential contact between the outside surface 34, 36 of each roller 28, 30 and the strip of material 22, as best exemplified in FIGS. 1, 2, and 5. In other words, the angle or distance the strip of material 22 wraps around each roller 28, 30 ("angle of wrap") and is in contact with the outside surface 34, 36 of each roller 28, 30 is more than a tangential point or line on the outside surface of the roller 28, 30. In the preferred embodiment, the position of the rollers 28, 30 may be adjusted from a position in which the outside surface 34, 36 of each roller 28, 30 makes tangential contact with the strip of material 22 to a position in which the strip of material 22 wraps around and contacts approximately one-quarter of the circumference of the outside surface 34, 36 of each roller 28, 30.

Normally, the material source 24 will provide some resistance to removal of the strip of material 22 by the material user 26. This resistance creates a tension in the strip of material 22 which tends to force the strip of material 22 into a linear or planar strip between the material source 24 and material user 26. As exemplified in FIGS. 1, 2, and 5, the greater than tangential contact between the outside surface 34, 36 of each roller 28, 30 and the strip of material 22 forces the strip of material 22 out of the linear or planar path, creating opposing forces between the outside surfaces 34, 36 of the rollers 28, 30 and the strip of material 22, and increasing the frictional resistance to slippage between the outside surfaces 34, 36 of the rollers 28, 30 and the strip of material 22. In many applications of the tensioning device, as further explained below, the strip of material 22 will be a pressure-sensitive material, such as protective tape for pipe or other conduit, and the opposing forces (or pressures) between the outside surfaces 34, 36 of the rollers 28, 30 and the strip of material 22 cause the desired non-sliding contact. The amount of contact or angle of wrap between the outside surface 34, 36 of each roller 28, 30 and the strip of material 22 should be adjusted to minimize or eliminate slippage between the outside surfaces 34, 36 and the strip of material 22 and to thereby achieve the desired tensioning in the strip of material 22.

The material of which the outside surfaces 34, 36 of the first and second rollers 28, 30 is constructed should be selected to maximize friction and/or adherence between the outside surfaces 34, 36 of the rollers 28, 30 and the strip of material 22 while still allowing the strip of material 22 to travel freely from the material source 24 to the material user 26. In the prototype of the tensioning device 20, the outside surfaces 34, 36 of the first and second rollers 28, 30 are made of aluminum. The outside surfaces 34, 36 of the rollers 28, 30 may also be made of urethane or of a material having an equivalent or higher coefficient of friction than urethane to increase the coefficient of friction of the outside surfaces 34, 36.

Figure 5:
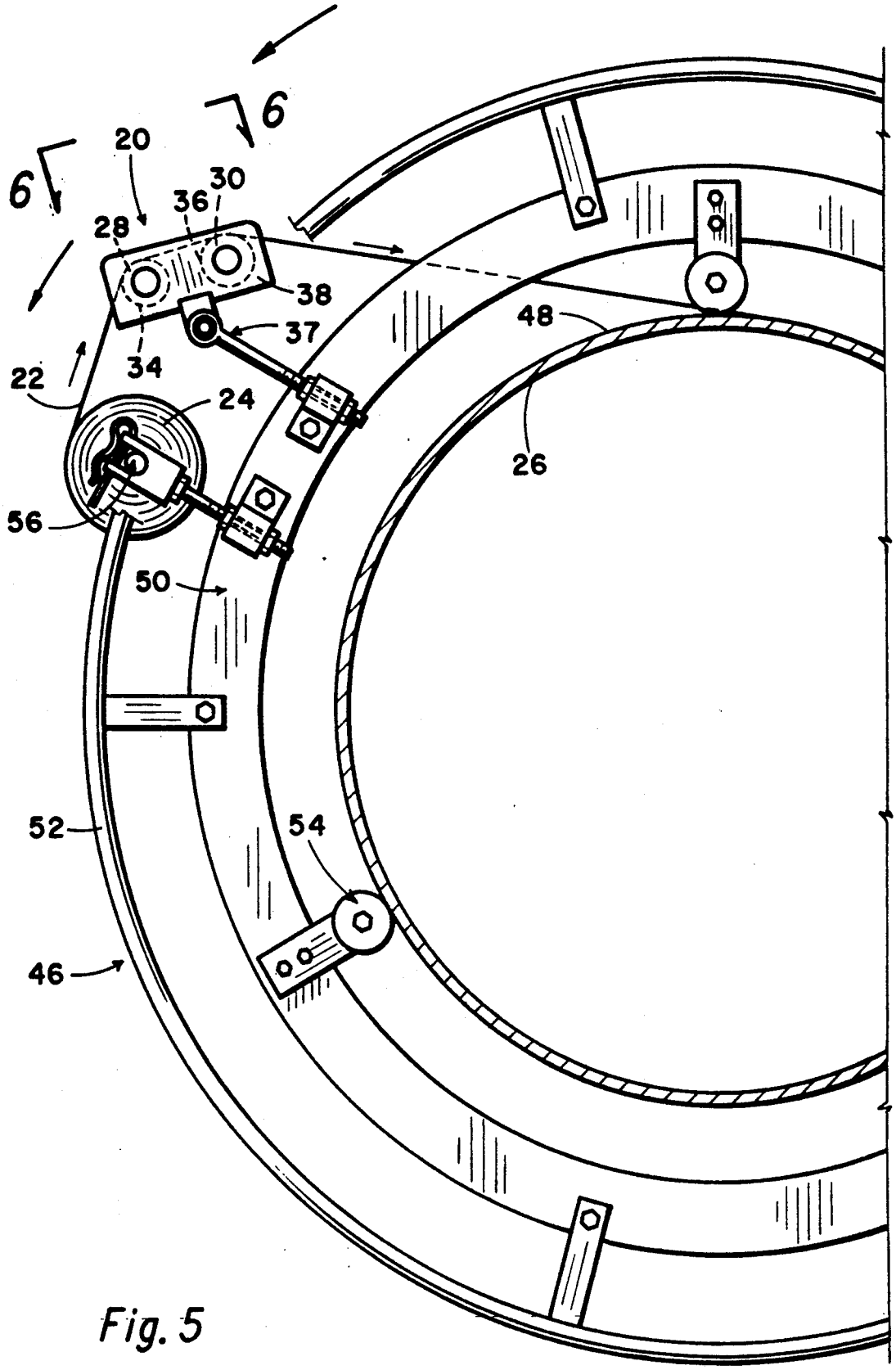
FIG. 5 is a partial side view of a pipe wrapping apparatus employing the tensioning device of the present invention.

In the preferred embodiment, referring to example FIGS. 1 and 5, the first and second rollers 28, 30 are positionable for contacting one side of the strip of material 22. This is preferable for installing and connecting the strip of material 22 from the material source 24 to the material user 26, since the strip of material 22 may be simply stretched across the outside surfaces 34, 36 of the rollers 28, 30 and there is no need to move the rollers 28, 30 or thread the strip of material 22 through the rollers 28, 30. If so desired, or required by space limitations, the first and second rollers 28, 30 may be arranged to contact both sides of the strip of material 22, i.e., the strip of material may form a serpentine path over one roller 28, 30 and under the other roller 28, 30, as exemplified in FIG. 2, in order to achieve the desired tensioning. In the preferred embodiment of FIG. 1, where the first and second rollers 28, 30 contact the same side of the strip of material 22, the rollers will rotate in the same direction. In the embodiment of FIGURE 2, where the rollers 28, 30 contact different sides of the strip of material 22 the rollers 28, 30 will rotate in the opposite directions and will therefore require modifications to the interconnection means 32 as discussed below.

Figure 3:
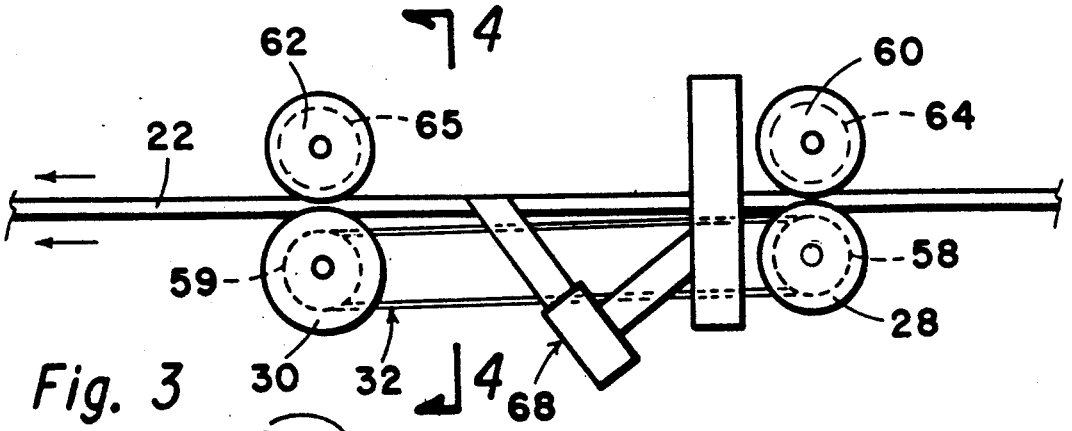
FIG. 3 is a schematic side view of a wrapping apparatus employing another embodiment of the tensioning device of the present invention.
Figure 6:
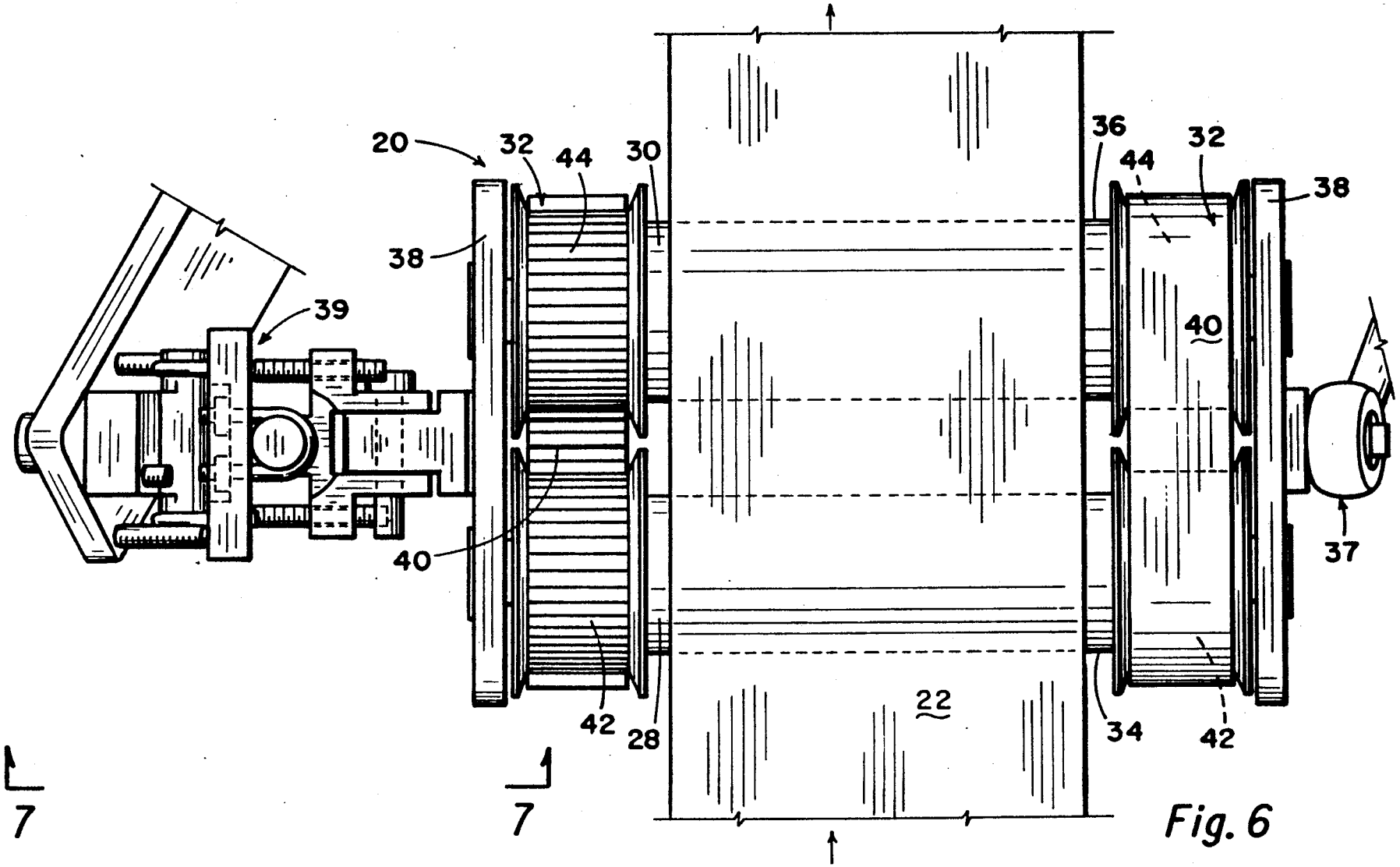
FIG. 6 is a sectional view along line 6—6 of FIG. 5.
Figure 7:
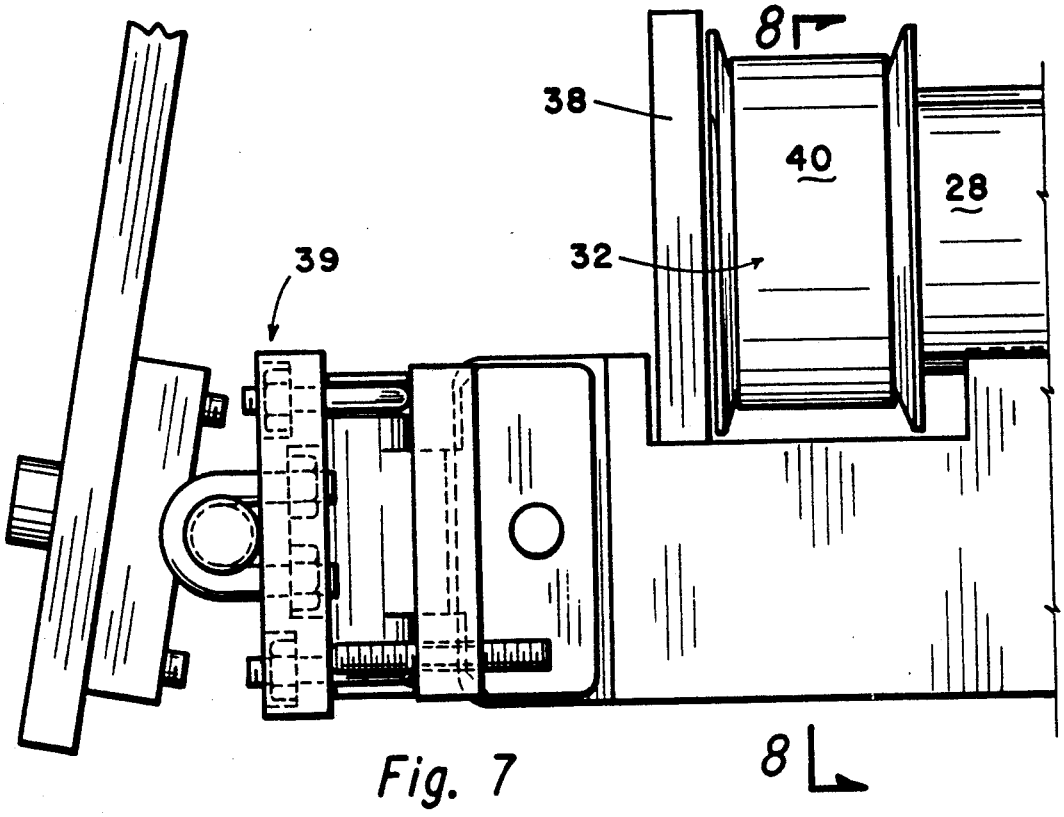
FIG. 7 is a sectional view taken along line 7—7 of FIG. 6.

The outside surface 34 of the first roller 28 and the outside surface 36 of the second roller 30 define the path of travel for the strip of material 22 between the material source 24 and the material user 26 with the outside surface 36 of the second roller 30 being located nearest the material user 26 in the path of travel. The rollers 28, 30 should be securely mounted to withstand the forces the strip of material 22 will place on them and the rotatable outside surfaces 34, 36 also should be sturdily constructed to withstand the forces of the strip of material 22. The rollers 28, 30 may be spaced apart, as illustrated in FIG. 3, or located near together, as illustrated in FIG. 6, as required by a specific application. The rollers 28, 30 may be independently rotatably mounted, as exemplified in FIGS. 3 and 4. In the preferred embodiment, illustrated in FIGS. 5–8, the first and second rollers 28, 30 are mounted in a common housing 38 immediately adjacent one another to conserve space and simplify positioning the rollers 28, 30 relative to the material source 24 and material supply 26. Referring to the example of FIG. 6, the rollers 28, 30 and housing 38 should be positionable relative to the material source 24 and material user 26, i.e., the mountings 37, 39 with which the rollers 28, 30 and housing 38 are mounted relative to the material source 24 and material user 26 should allow the position of the rollers 28, 30 relative to the material source 24 and material user 26 to be adjusted. As previously discussed, the amount of contact between the outside surfaces 34, 36 of the rollers 28, 30 and the strip of material 22 may need to be adjusted to provide non-sliding contact between the strip of material and the outside surfaces 34, 36. This adjustment may be provided by something as simple as a series of holes (not illustrated) through which the rollers 28, 30 can be independently bolted to a housing (not illustrated). In the preferred embodiment, the mountings 37, 39 are independently adjustable and allow the rollers 28, 30 to be adjusted about their longitudinal, normal, and lateral axes so that both the amount and angle of contact between the outside surfaces 34, 36 of the rollers 28, 30 and the strip of material 22 may be adjusted.

The interconnection means 32 may take the form of directly interconnected gears (not illustrated), e.g., one gear mounted on each of the first and second rollers 28, 30 with the gear cogs directly interconnected, which would result in the rollers 28, 30 turning in opposite directions. If it is desired to use directly interconnected gears with the rollers 28, 30 turning in one direction it is necessary to have a third gear (not illustrated) directly interconnected between the gears mounted on each of the first and second rollers 28, 30, or equivalent connections. In the preferred embodiment, referring to FIG. 8, the interconnection means 32 may be effected by a chain-like belt 40, a first sprocket 42 mounted on the first roller 28, and a second sprocket 44 mounted on the second roller 30 with the belt or chain 40 connected between the first and second sprockets 42, 44 to rotate the first and second rollers 28, 30. The chain-like belt 40 may be replaced with any equivalent belt-like device and the sprockets 42, 44 may be replaced with pulleys or equivalent devices. The use of the chain-like belt 40, first sprocket 42, and second sprocket 44 or equivalents will result in the first and second rollers 28, 30 turning in the same direction if constructed and arranged as illustrated in FIG. 8. Multiple chains and sprockets or belts and pulleys may be used if it is desired to rotate the rollers 28, 30 in opposite directions or to accommodate various spacial arrangements of the rollers 28, 30.

In another preferred embodiment, exemplified in FIG. 6, a first sprocket 42 is mounted on each end of the first roller 28, a second sprocket 44 is mounted on each end of the second roller 30, and a sprocketed timing belt 40 is connected between each set of sprockets 42, 44. Belts and sprockets are provided at both ends of the rollers 28, 30 so that smaller, lighter belts and sprockets may be used, i.e., rather than one larger, stronger belt with larger, stronger sprockets. The smaller sizes of the belts and sprockets are used to accommodate limited spacial arrangements, i.e., in applications where there is not room for the larger belt and sprockets required if only one belt 40 and two sprockets 42, 44 are used.

As discussed above, the interconnection means 32 rotates the outside surface of the first roller 28 at a slower tangential velocity than the outside surface of the second roller 30. This may be accomplished by making the first and second rollers 28, 30 the same size and diametrical cross-section and using the gearing ratio or drive ratio of the interconnection means 32 to rotate the first roller 28 at a slower angular velocity than the second roller 30. That is, since the first and second rollers 28, 30 are the same size and diametrical cross-section, in order to have different tangential velocities they must have different angular velocities. This may be accomplished by direct gear interconnection (not illustrated) in which case the gear of the first roller would have a larger number of teeth than the gear of the second roller 30, or by chain and sprocket or belt 40 and pulley 42, 44 in which case the sprocket or pulley of the first roller would be larger than the corresponding sprocket or pulley of the second roller in order to rotate the first roller 28 at a slower angular velocity than the second roller 30. This embodiment, having rollers 28, 30 of the same size and diametrical cross-section, directly tensions the chain or belt 40 with the same tension that is placed on the strip of material 22 and is believed to place greater stress on the interconnection means 32 and therefore have a higher failure rate than the preferred embodiment discussed in the next paragraph.

In the preferred embodiment, the first roller 28 is smaller in diametrical cross-section than the second roller 30. The interconnection means 32 rotates the rollers 28, 30 at the same angular velocity which results in the first roller, which is smaller in diameter, having a slower tangential velocity. The slower tangential velocity of the first roller 28 results in the desired tensioning of the strip of material 22. The effect of this tensioning is believed to be less damaging to the interconnection means 32 than the embodiment discussed in the previous paragraph. In the prototype, the first roller 28 is one and seven-eighths inches in diameter and the second roller 30 is two inches in diameter which results in approximately twelve to fifteen pounds of tensioning per inch of width of the strip of material 22 when the strip of material 22 is a typical pressure-sensitive tape as used for wrapping pipe. Polyken 980-25 pipe insulating tape as currently manufactured by the Kendall Corporation was used to achieve these test results with the prototype tensioning device 20.

Figure 9:
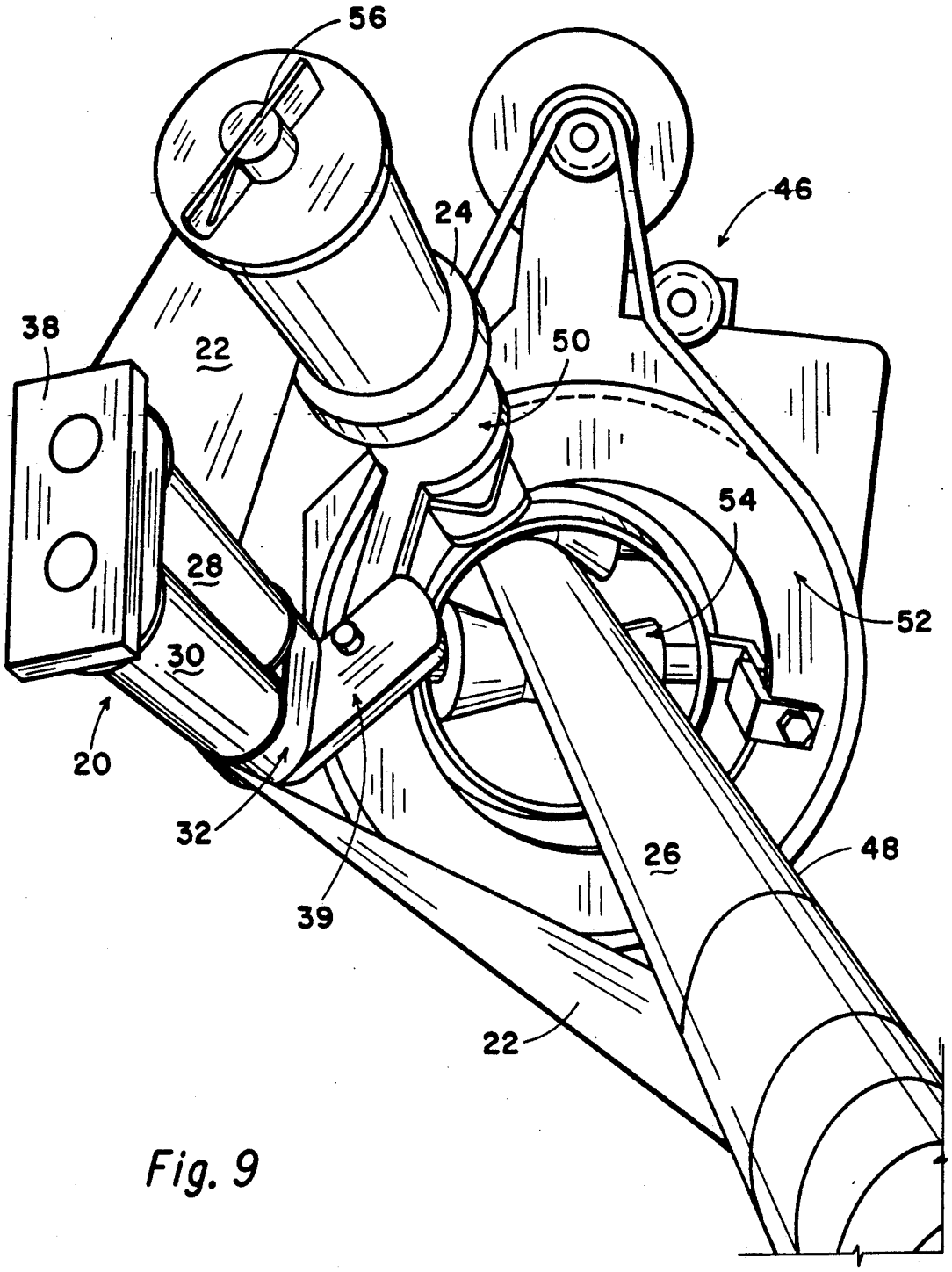
FIG. 9 is a perspective view of a pipe wrapping machine employing the tensioning device of FIG. 1.

FIGS. 5 and 9 exemplify typical uses of the tensioning device 20 of the present invention. FIG. 5 typifies a manually operated pipe wrapping apparatus. FIG. 9 typifies a power driven pipe wrapping apparatus. Referring to the examples of FIGS. 5 and 9, power means 46 are provided for removing the strip of material from the material source 24, for advancing the strip of material 22 along the path of travel defined by the outside surfaces 34, 36 of the first and second rollers 28, 30, and for delivering the tensioned strip of material 22 to the material user 26. In the embodiment of FIGS. 5 and 9, the material user 26 is an elongate member, such as a pipe, rod, control cable, conduit, etc. having an outside surface 48. The power means 46 may simply rotate the material user 26 in order to pull the strip of material 22 through the tensioning device 20 from the material source 24. The second roller 30 or both of the rollers 28, 30 also may be driven by the power means 46 to advance the strip of material 22.

Referring to example FIGS. 5 and 9, more typically, the power means 46 includes support means 50 for rotatably supporting the material source 24, first roller 28, and second roller 30; revolving means 52 for revolving the support means 50 and the outside surface 48 of the material user 26 relative to each other; and advancement means 54 for advancing and positioning the support means 50 and the material user 26 relative to each other along the length of the material user 26. As seen in FIGS. 5 and 9, one end of the strip of material 22, which is normally a pressure-sensitive tape, is applied to the material user 26, which is typically a pipe, and the support means 50 is revolved around the material user 26. As the support means 50 is revolved, the strip of material 22 is pulled from the material source 24, which is typically a tape spool, through the tensioning device 20 and the tensioned strip of material 22 is applied to the material user or pipe 26. Normally in these types of devices, the rollers 28, 30 are not directly power driven, i.e., the strip of material 22 is pulled through the tensioning device 20 and rollers 28, 30 by its application to the material user 26. The movement of the strip of material 22 across the rollers 28, 30 provides the power to rotate the rollers 28, 30 and the interconnection means 32 regulates the relative angular and tangential velocities of the rollers 28, 30.

Brake means 56 should be provided in the material source 24 for resisting the travel of the strip of material 22 from the material source 24 to the material user 26. The brake means 56 keeps the material source 24 from continuing to unwind or dump material if travel of the strip of material 22 through the tensioning device is stopped suddenly. The brake means 56 also provides some tension in the strip of material 22 which helps to provide the desired non-sliding contact between the strip of material 22 and the outside surfaces 34, 36 of the first and second rollers 28, 30, as discussed above. The tension provided by the brake means 56 in the material source 24 is not uniform, i.e., as the circumference of the material source 24 decreases with removal of the strip of material 22, the tension provided by the brake means 56 in the material source 24 increases. The tension device 20 eliminates this non-uniform tension in the strip of material 22 and provides a constant tension between the tensioning device 20 and the material user 26. In other words, the tensioning device 20, when used with a pipe wrapping apparatus, provides that the strip of material 22 or tape is applied to the material user 26 or pipe at a uniform tension.

Typical environments and details of the tension device 20, such as the roller mountings 37, 39, power means 46, support means 50, revolving means 52, advancement means 54, and brake means 56, are not disclosed in detail in this description since these are well known features of manual and power driven pipe wrapping apparatus. Examples of power driven pipe wrapping apparatus which disclose these features may be found in U.S. Pat. No. 2,657,866; U.S. Pat. No. 4,069,088; and U.S. Pat. No. 4,610,403 which are incorporated herein by reference thereto. Examples of manually operated pipe wrapping machines which disclose these features may be found in U.S. Pat. No. 3,470,057; U.S. Pat. No. 3,547,731; U.S. Pat. No. 4,113,545; U.S. Pat. No. 4,125,422; U.S. Pat. No. 4,322,262; and U.S. Pat. No. 4,358,064 which are incorporated herein by reference thereto.

Figure 4:
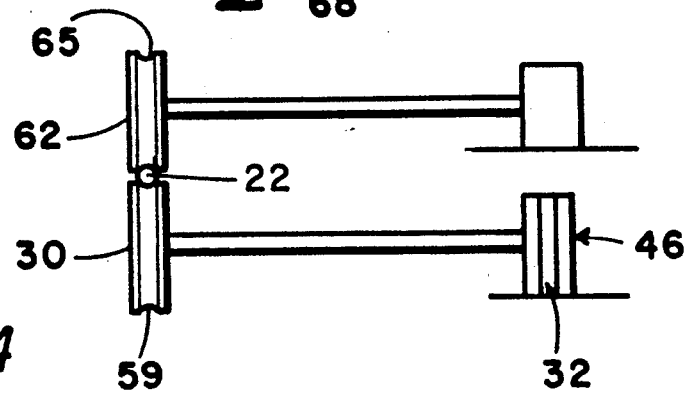
FIG. 4 is a schematic sectional view taken along line 4—4 of FIG. 3.

FIGS. 3 and 4 illustrate another embodiment of the present invention. The embodiment of FIGS. 3 and 4 is used for tensioning a strip of material 22 which, because of the fragile nature of the strip of material 22, or because of the material of which the strip of material 22 is made, or because of the shape of the transverse cross-section of the strip of material, cannot be tensioned in the embodiments previously discussed. Examples of such a strip of material 22 include control cables, wire, strip materials too rigid to form greater than tangential contact with rollers 28, 30, etc. Referring to FIGS. 3 and 4, it can be seen that the first and second rollers 28, 30 are disc-shaped having peripheral grooves 58, 59. The strip of material 22 travels through the peripheral grooves 58, 59. Pinch roller means 60, 62 are provided for holding the strip of material 22 in effectively non-sliding contact with the outside surfaces 34, 36 (or peripheral grooves 58, 59) of the first and second rollers 28, 30 as the strip of material 22 travels from the material source 24 to the material user 26.

The pinch roller means 60, 62 include a first pinch roller 60 and a second pinch roller 62. The pinch rollers 60, 62 have peripheral grooves 64, 65. When the pinch rollers 60, 62 are positioned against the first and second rollers 28, 30, as exemplified in FIGS. 3 and 4, the peripheral grooves 58, 59, 64, 65 adjoin one another. The peripheral grooves 58, 59, 64, 65 should be sized to securely engage the strip of material 22 against the pinch rollers 60, 62 and the first and second rollers 28, 30. Engagement means (not illustrated) may be provided for moving the pinch roller means 60, 62 between a first position holding the strip of material 22 in non-sliding contact with the first and second rollers 28, 30 to a second position spaced away from the first and second rollers 28, 30 in order to facilitate placing a strip of material 22 in position for tensioning. Interconnection means 32 are provided and operate as with the embodiments discussed supra. As illustrated in FIG. 4, interconnection means 32 may be spaced away from the first and second rollers 28, 30 and pinch rollers 60, 62 to provide room for a wrapping mechanism 68. The first roller 28 and first pinch roller 60 may be spaced apart from the second roller 30 and second pinch roller 62 to provide room for the tape wrapping mechanism 68 between them. Normally, the first and second rollers 28, 30 are directly power-driven to assist in advancing the strip of material 22 from the material source 24 to the material user 26. In any of the embodiments of the tensioning device 20 where the first and second rollers 28, 30 are power driven, the interconnection means 32 may be provided by the power source (not illustrated), i.e., the power source driving the rollers 28, 30 may simply drive the rollers 28, 30 at different tangential velocities to achieve the desired tensioning.

The tensioning device of FIGS. 3 and 4, is typically used for tensioning control cable to allow protective tape 70 to be applied to the control cable. Typically, tape wrapping mechanisms 68 used to apply tape to control cable are very small and the arrangement of FIGS. 3 and 4 is intended to accommodate the size of such a tape wrapping mechanism. Also, the arrangement of FIGS. 3 and 4 provides a working area adjacent the tensioned strip of material 22, i.e., between the first and second rollers 28, 30 and eliminates the need for maintaining tension in the strip of material 22 in areas not between the first and second rollers 28, 30.

While the invention has been described with a certain degree of particularity, it is manifest that many changes may be made in the details of construction and the arrangement of components without departing from the spirit and scope of this disclosure. It is intended to be understood that the invention is not limited to the embodiments set forth herein for purposes of exemplification, but the invention is to be limited only by the scope of the attached claims, including the full range of equivalency to which element thereof is entitled.

What is claimed is:

1. A tensioning device for removing a strip of material from a material source and applying the strip of material under a desired tension onto an outside surface of a material user, comprising:

a housing;

a first and a second roller mounted in the housing immediately adjacent each other, the first and second rollers mounted adjustably in the housing relative to the material source and the material user, the first roller non-slidingly contacting a portion of the strip of material, the second roller mounted in the housing between the first roller and the material user, the second roller non-slidingly contacting a portion of the strip of material, interconnection means simultaneously rotating the first and second rollers in a manner that the surface of the first roller travels at a slower tangential velocity than the surface of the second roller, a mounting upon which the housing is mounted in a manner to permit the rollers to be adjusted about their axes, support means rotatably and adjustably supporting the material source and the housing, revolving means revolving the support means around the outside surface of the material user, and advancement means advancing the support means relative to the length of the material user.

2. A tensioning device as described in claim 1, wherein:

the first and second rollers are of the same diameter.

3. A tensioning device as described in claim 2, wherein:

the first and second rollers contact the same side of the strip of material.

4. A tensioning device as described in claim 2, wherein:

the first and second rollers contact opposite sides of the strip of material.

5. A tensioning device as described in claim 1, wherein:

the first roller is of a smaller diameter than the second roller.

6. A tensioning device as described in claim 5, wherein:

the first and second rollers contact the same side of the strip of material.

7. A tensioning device as described in claim 5, wherein:

the first and second rollers contact opposite sides of the strip of material.

8. A tensioning device as described in claim 1, wherein:

the first and second rollers contact the same side of the strip of material.

9. A tensioning device as described in claim 1, wherein:

the first and second rollers contact opposite sides of the strip of material.

* * * * *